US006581424B2

(12) United States Patent
Oliver

(10) Patent No.: US 6,581,424 B2
(45) Date of Patent: Jun. 24, 2003

(54) PORTABLE LOCK BOX

(76) Inventor: Randy M. Oliver, 8758 Adaline St., North Charleston, SC (US) 29406

( * ) Notice: Subject to any disclaimer, the term of this patent is extended or adjusted under 35 U.S.C. 154(b) by 0 days.

(21) Appl. No.: 09/846,970

(22) Filed: May 1, 2001

(65) Prior Publication Data

US 2002/0162367 A1 Nov. 7, 2002

(51) Int. Cl.[7] ..... B65D 55/14; E05G 1/024

(52) U.S. Cl. ..... 70/164; 70/63; 70/167; 109/58; 109/73

(58) Field of Search ..... 70/63, 164, 163, 70/166, 167, 168, 169, 170, 171, 172, 173; 109/58, 73, 79; 220/8, 345.2, 351, 345.4

(56) References Cited

U.S. PATENT DOCUMENTS

| | | | | | |
|---|---|---|---|---|---|
| 85,647 | A | * | 1/1869 | Dolan | 109/73 |
| 3,126,444 | A | * | 3/1964 | Taylor | 174/101 |
| 3,667,406 | A | * | 6/1972 | Shea | 109/57 |
| 3,710,736 | A | * | 1/1973 | Biondi et al. | 109/50 |
| 4,029,370 | A | | 6/1977 | Ziegel et al. | |
| 4,195,378 | A | | 4/1980 | Parker | |
| 4,249,684 | A | | 2/1981 | Miller et al. | |
| 4,470,518 | A | * | 9/1984 | Stein | 109/45 |
| 4,535,890 | A | * | 8/1985 | Artusi | 206/468 |
| 4,664,041 | A | * | 5/1987 | Wood | 109/51 |
| 5,076,405 | A | | 12/1991 | Modica | |
| 5,129,538 | A | * | 7/1992 | Bennett | 220/315 |
| 5,199,361 | A | | 4/1993 | Robinson | |
| 5,405,034 | A | * | 4/1995 | Mittel, Jr. | 215/322 |
| 5,513,580 | A | * | 5/1996 | Franks | 109/51 |
| 5,526,907 | A | | 6/1996 | Trawick et al. | |
| 5,657,916 | A | | 8/1997 | Tackett | |
| 5,977,876 | A | * | 11/1999 | Coleman | 340/571 |
| 6,085,671 | A | | 7/2000 | Kerr et al. | |
| 6,364,329 | B1 | * | 4/2002 | Holub et al. | 280/47.26 |

* cited by examiner

*Primary Examiner*—Anthony Knight
*Assistant Examiner*—Michael J. Kyle
(74) *Attorney, Agent, or Firm*—Dale J. Ream

(57) ABSTRACT

A portable lock box includes a box-shaped base member having an open front and top and a box-shaped front closure member having an open back and top. The base and front closure members include complementary horizontal support members and the front closure member is dimensioned to be slidably received through the open front of the base member to form a base assembly that may be filled with ballast. Respective support members define apertures through which elongate fasteners may be extended when aligned so as to couple the front closure member to the base member. A top panel is configured for slidable engagement with the base member so as to cover the open top. The top panel and base member include corresponding bores through which a rod may be extended and locked. Selected items may be stowed for safekeeping in a compartment mounted to an underside of the top panel.

4 Claims, 8 Drawing Sheets

PORTABLE LOCK BOX

BACKGROUND OF THE INVENTION

The present invention relates generally to security devices and, more particularly, to a portable lock box having a base assembly that can be filled with ballast and having a lid with a security compartment that may be locked to the base assembly.

Many people enjoy spending time relaxing on a beach and participating in related activities such as swimming, beach volleyball, and the like. While it is necessary to carry certain valuable items to the beach such as keys, wallets, watches, glasses, etc., there is typically no secure location to stow these items while the owner thereof is away participating in other activities. Theft of such items occurs frequently.

Various devices have been proposed in the art for stowing valuable items for safekeeping. These devices typically utilize a safe or lock box in which valuables are stowed behind a lockable door. Although assumably effective, small portable safes are themselves easy to steal when left unattended, such as on a beach, and larger safes are simply not easily transportable.

Therefore, it is desirable to have a portable lock box which is small and lightweight so that it may be carried to a beach setting along with other necessary items. Further, it is desirable to have a lock box which can be configured to be filled with ballast such as sand once it is positioned at a desired location. Finally, it is desirable to have a lock box having a lid that includes a table top surface on a top side and a compartment for storing valuables on a bottom side.

SUMMARY OF THE INVENTION

A portable lock box includes a two-pan base assembly with a top panel that may be releasably locked to the base assembly. The base assembly includes a primary base member having a bottom wall with a back wall and a pair of side walls extending upwardly therefrom to form a box-shaped structure having an open top and open front. The base assembly further includes a front closure member having a bottom wall with a front wall and a pair of side walls extending upwardly therefrom to form a box-shaped structure having an open top and an open back. The front closure member has dimensions smaller than those of the base member and is configured to be slidably received into the base member through the open front thereof. The base and front closure members include complementary horizontal support members to facilitate this slidable movement. Elongate fasteners such as bolts may extend through apertures through respective support members for coupling the base and front closure members together. When coupled together, the base assembly forms a box of variable dimension that may be filled with ballast such as sand, ice, beach accessories, etc. such that the lock box, when filled, would be heavy to carry or steal.

The portable lock box includes a top panel or lid having top and bottom sides and a generally square configuration capable of covering the open top of the base assembly. Mating flange and channel structures allow the top panel to be slidably coupled to the base member. These structures also define bores through which a rod may be extended when aligned. A padlock may be engaged at an end of the rod whereby to lock the rod therein and prevent removal of the top panel 60. A compartment is mounted to the bottom said of the top panel for receiving valuables therein for safekeeping. As the compartment is positioned to the inside of the top panel and base assembly, items stowed therein are protected from thievery as is the portable lock box itself due to the weight of the ballast therein.

Therefore, a general object of this invention is to provide a portable lock box that is lightweight and easy to transport to a beach setting.

Another object of this invention is to provide a portable lock box, as aforesaid, in which the volume of a base assembly is adjustable.

Still another object of this invention is to provide a portable lock box, as aforesaid, into which ballast may be added or removed to vary the weight thereof.

Yet another object of this invention is to provide a portable lock box, as aforesaid, having an interlocking configuration that is easy to assemble and secure.

A further object of this invention is to provide a portable lock box, as aforesaid, which includes an inner compartment for stowing and securing valuables for safekeeping and keeping them separated from the ballast.

A still further object of this invention is to provide a portable lock box, as aforesaid, which operates as a table top and support surface.

Other objects and advantages of this invention will become apparent from the following description taken in connection with the accompanying drawings, wherein is set forth by way of illustration and example, embodiments of this invention.

BRIEF DESCRIPTION OF THE DRAWINGS

FIG. 7*b* is a top view of the front closure member as in FIG. 7*a.

DESCRIPTION OF THE PREFERRED EMBODIMENT

Figure 1:
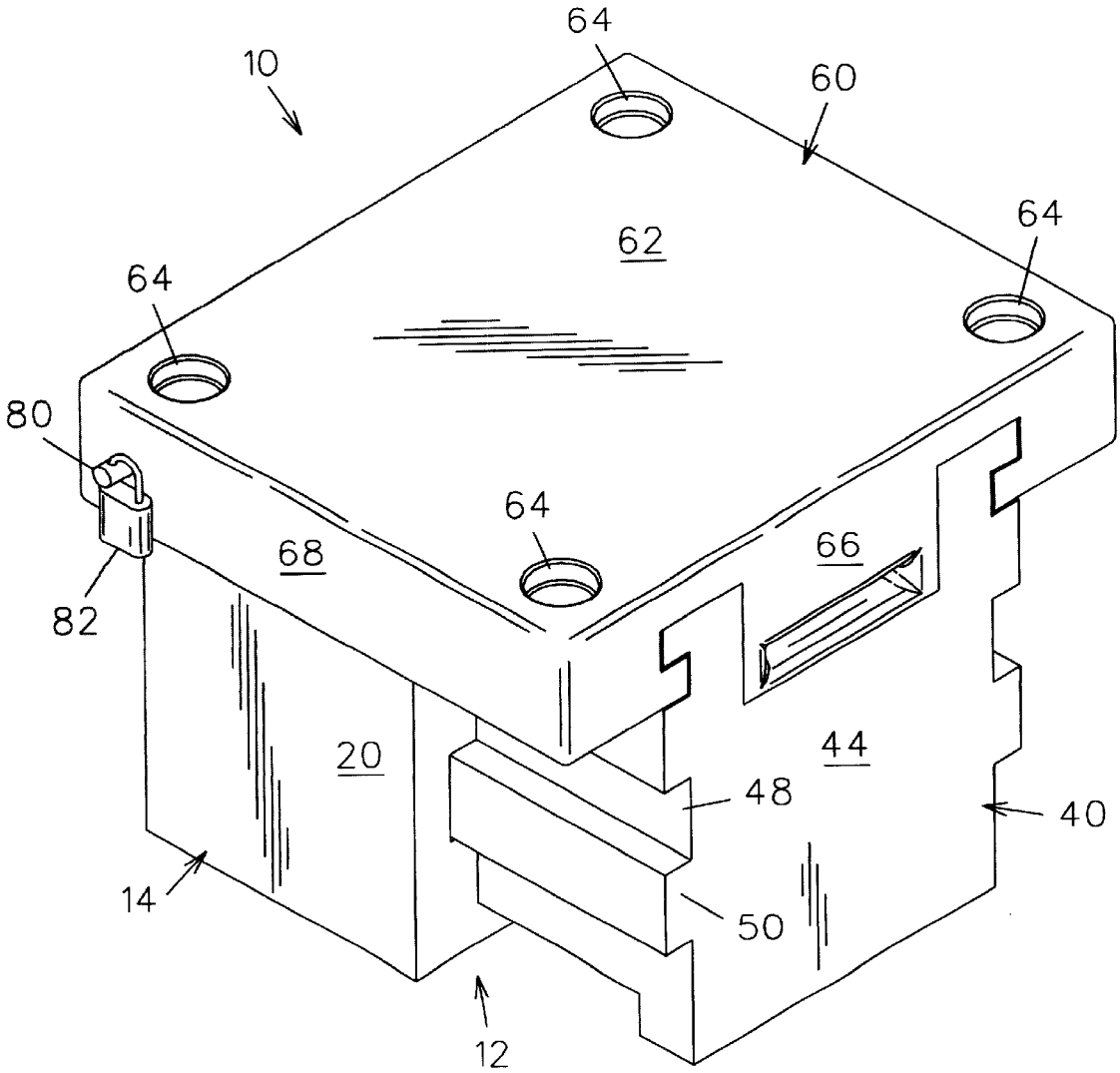
FIG. 1 is a perspective view of a portable lock box in an extended configuration according to a preferred embodiment of the present invention.
Figure 2:
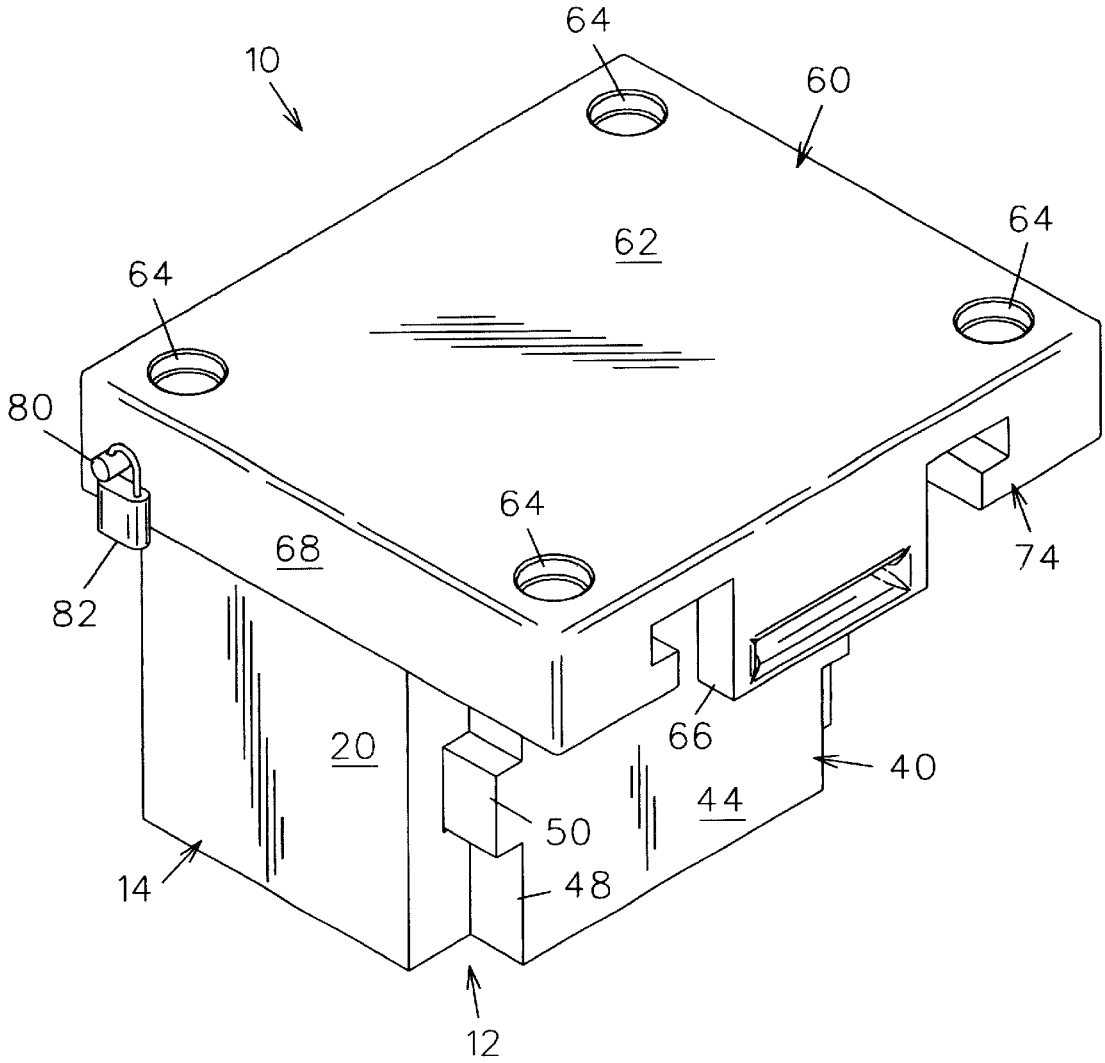
FIG. 2 is a perspective view of the lock box as in FIG. 1 in a retracted configuration.
Figure 3:
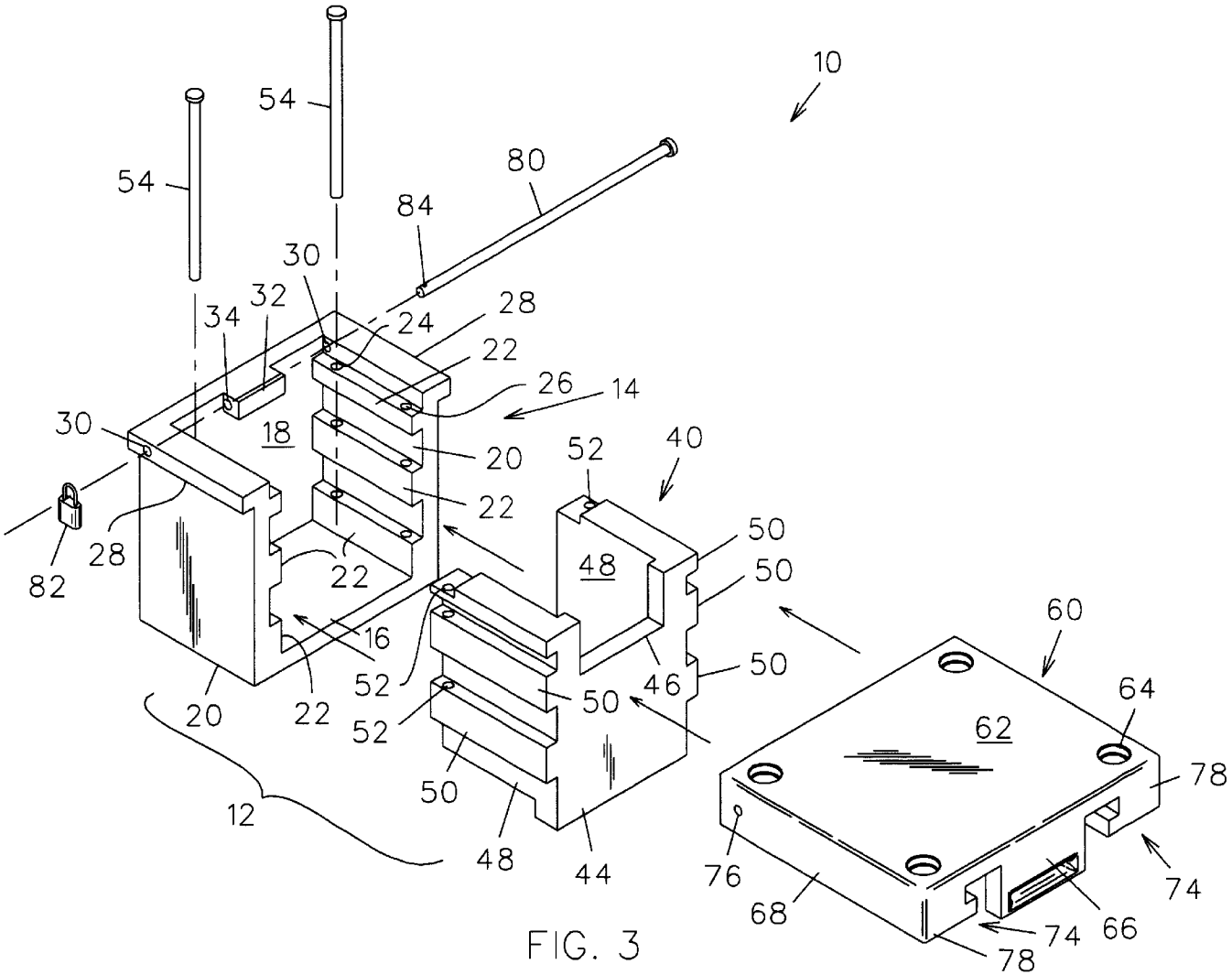
FIG. 3 is an exploded view of the lock box as in FIG. 1.
Figure 4:
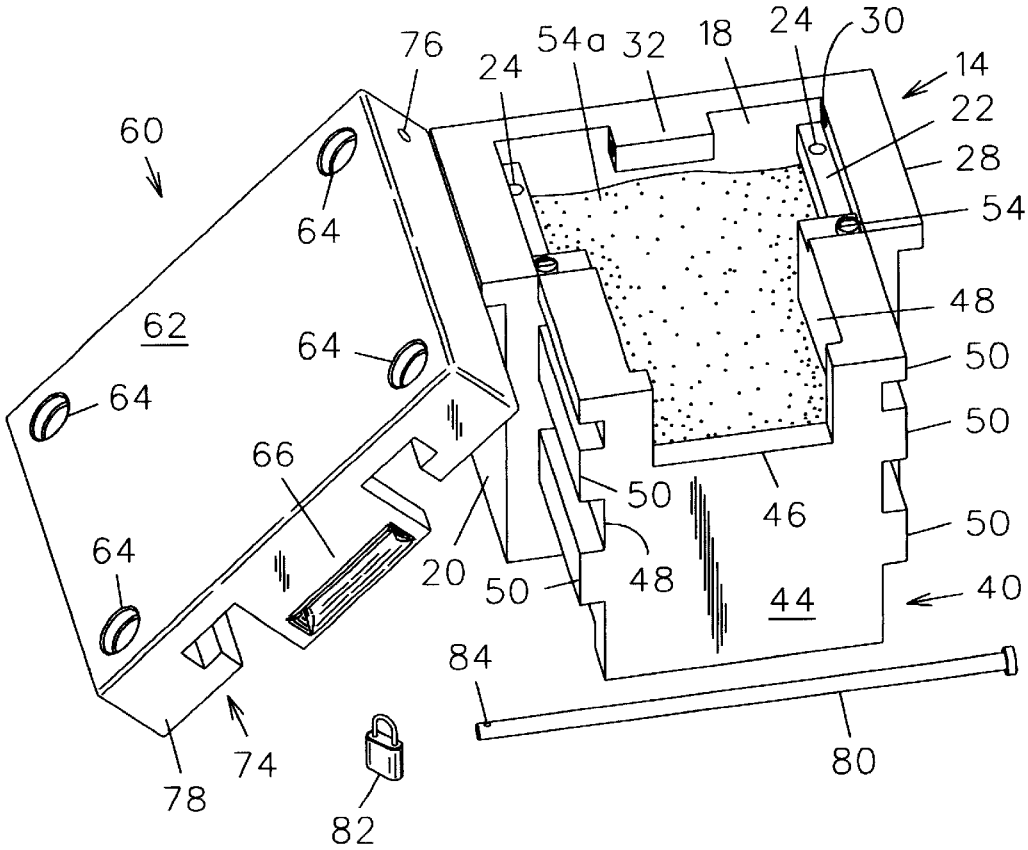
FIG. 4 is a perspective view as in FIG. 1 with the top panel removed from the base assembly.

A portable lock box according to the present invention will now be described in detail with reference to FIGS. 1 through 8 of the accompanying drawings. One embodiment of a portable lock box 10 includes a two-part base assembly 12 with a removable top panel 60 (FIG. 4). The base assembly 12 includes a base member 14 having a bottom wall 16 with a back wall 18 and a pair of side walls 20 normal to and extending upwardly from the bottom wall 16, the back wall 18 extending between the side walls 20 (FIG. 3). Similarly, the base assembly 12 includes a front closure member 40 having a bottom wall 42 with a front wall 44 and a pair of side walls 48 normal to and extending upwardly from the bottom wall 42, the front wall 44 extending between the side walls 48. The front wall 44 of the front closure member 40 defines a cutout 46 at the top edge thereof (FIG. 4). The front closure member 40 is dimensioned to be received into the base member 14 through the open front thereof, as to be described more fully below.

A plurality of first support members 22 are integrally connected to respective inner surfaces of the side walls 20 of the base member 14 (FIG. 3). The first support members 22 are horizontally disposed thereon and vertically spaced apart. Each first support member 22 defines a first aperture 24 generally adjacent the back wall 18 and extending vertically through the member. Each first support member 22 further defines a second aperture 26 generally adjacent the open front and extends vertically therethrough. Therefore, the first apertures 24 are in alignment according to a first imaginary vertical axis extending therethrough and the second apertures 26 are in alignment according to a second imaginary vertical axis extending therethrough.

A plurality of second support members 50 are integrally connected to outer surfaces of respective side walls 48 of the front closure member 40 (FIG. 3). The second support members 50 are horizontally disposed thereon and vertically spaced apart. The second support members 50 are positioned complementary to the first support members 22 such that each second support member 50 may rest atop a corresponding first support member 22 when the front closure member 40 is inserted through the open front of the base member 14 (FIG. 4). Each second support member 50 defines a third aperture 52 substantially adjacent a free edge of respective side walls 48, respective apertures being aligned with a third imaginary vertical axis extending therethrough.

The front closure member 40 may be inserted into the base member 14 through the open front thereof. Upon insertion, each second support member 50 rests atop a corresponding first support member 22 and the bottom wall 42 of the front closure member 40 rests atop the bottom wall 16 of the base member 14. The second support members 50 are slidable along the first support members 22 between the back wall 18 and the open front of the base member 14. When the front edge of the bottom wall 42 of the front closure member 40 is selectively positioned adjacent the back wall 18 of the base member 14, respective first 24 and third 52 apertures are vertically aligned such that an elongate fastener 54, such as a long bolt, may be inserted therethrough to couple the front closure member 40 and base member 14 together (FIG. 2). This is referred to as a retracted or first configuration. Or, when the front edge of the bottom wall 42 of the front closure member 40 is selectively displaced from the back wall 18 and is positioned substantially adjacent the free edge of the base member (i.e near the open front), the second 26 and third 52 apertures are vertically aligned such that an elongated elongate fastener 54 may be inserted therethrough to couple the front closure and base members together. (FIGS. 1 and 4). This is referred to as an extended or second configuration. In either configuration, the base assembly 12 forms a box-like configuration having an open top so that ballast 54*a*, such as sand, ice, or the like, may be added thereto. Of course, the volume of space available for ballast depends on the adjustment of the base assembly 12 between extended and retracted configurations.

Figure 5:
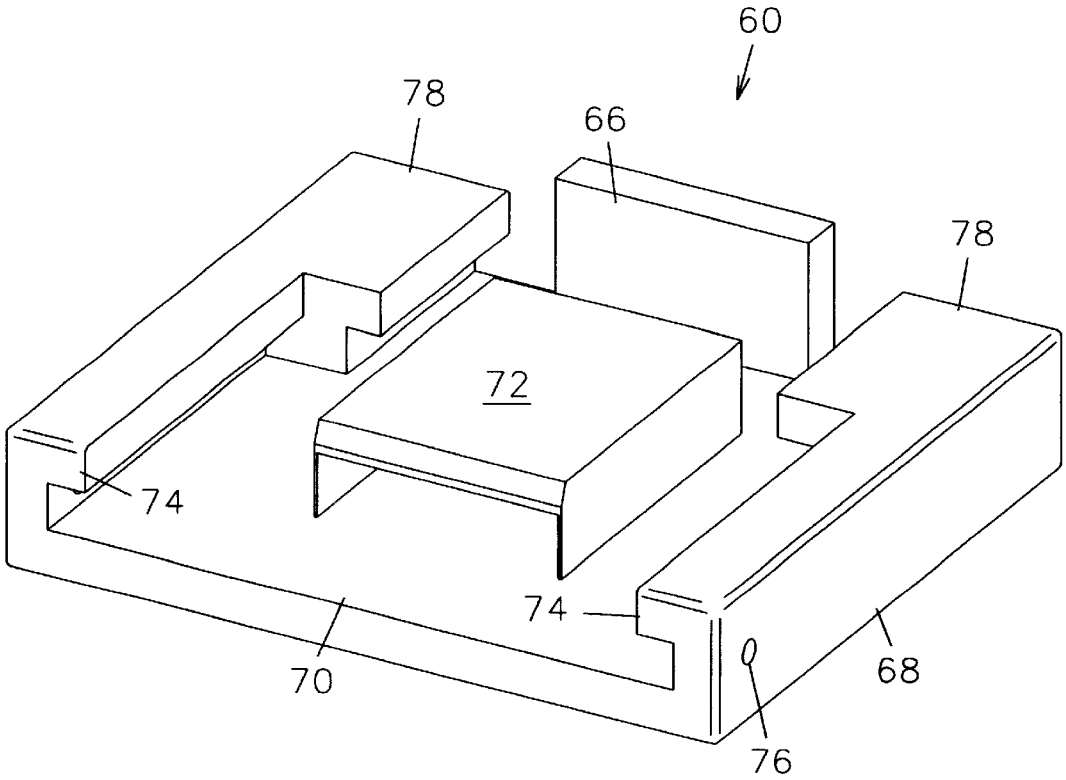
FIG. 5 is perspective view of a bottom side of the top panel.
Figure 6B:
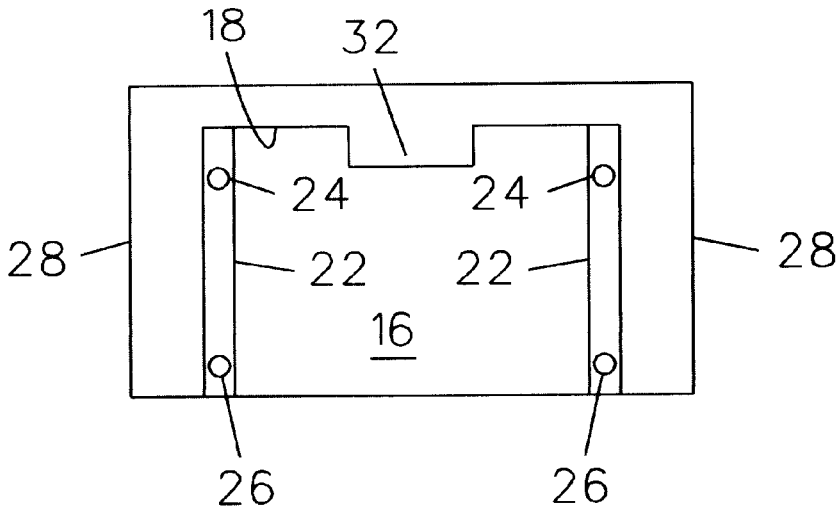
FIG. 6*b* is a top view of the base member as in FIG. 6*a;*
Figure 6A:
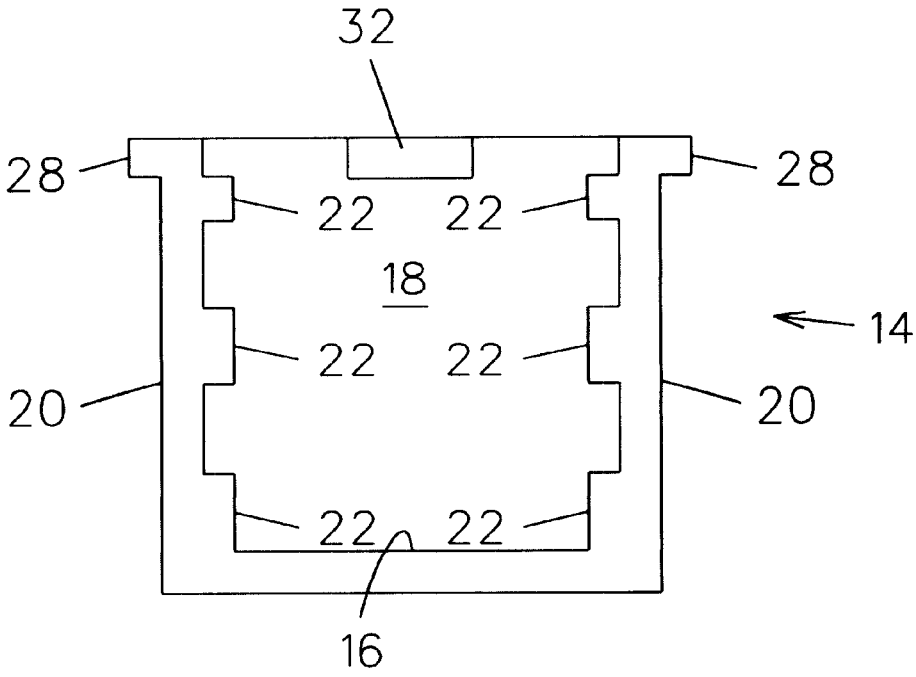
FIG. 6*a* is a front view of the base member as in FIG. 3.
Figure 7B:
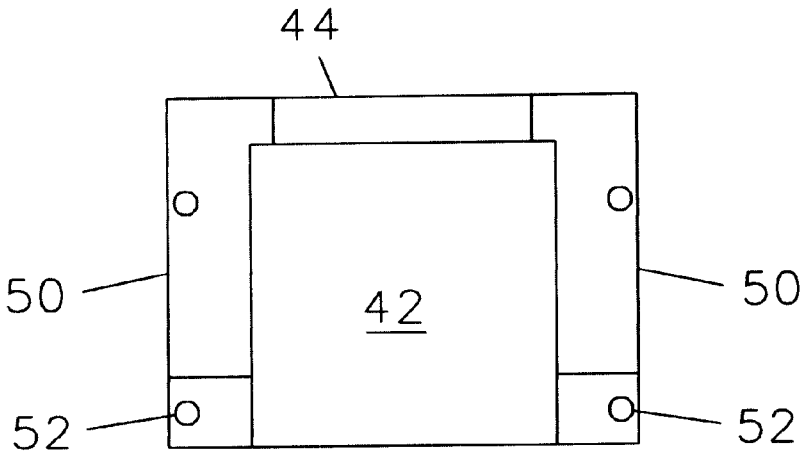
Figure 7A:
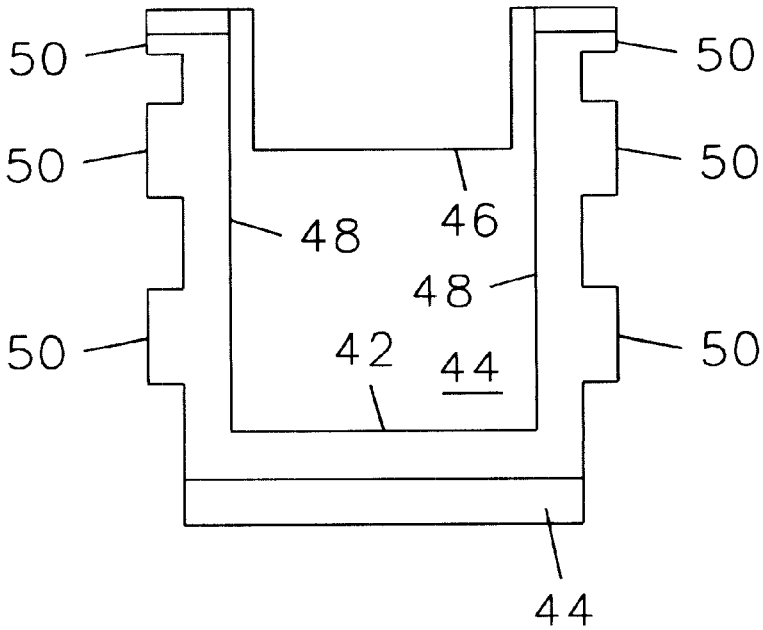
FIG. 7*a* is a rear view of the front closure member as in FIG. 3.

The portable lock box 10 further includes a top panel 60 having a generally square configuration (FIG. 3). The top panel 60, also referred to as the lid, includes a top side 62 defining a plurality of circular recesses 64 capable of supporting beverage containers like cups or cans therein. A handle member 66 depends from a front edge of the top panel 60 and is normal to the top side 62, the handle member having a recessed area wherein a user may grasp and carry the top panel (FIG. 4). The top panel 60 includes a bottom side 70 to which a compartment 72 is fixedly attached (FIG. 5). The compartment 72 includes an open back so that selected items, such as wallets, keys, glasses, and the like, may be stowed therein.

A pair of L-shaped guide members 74 depend from the bottom side 70 of the top panel 60 and are integrally connected to side edges 68 thereof (FIG. 5). Each guide member 74 defines a channel capable of slidably coupling the top panel 60 to the base member 14 as to be described more fully below. Although still displaced from said handle member 66, a front portion 78 of each guide member 74 extends more inwardly toward said handle member 66 than rearward portions thereof so as to slidably mate with respective second support members 50 of the front closure member 40 (FIG. 1). The base member 14 includes a pair of attachment flanges 28 extending outwardly along top edges of the side walls 20 thereof (FIGS. 3 and 4). The attachment flanges 28 have a configuration that is complementary to the channels of the guide members 74 and are slidable therein such that the top panel 60 may be slidably coupled to the base member 14.

Each guide member 74 defines a bore 76 therethrough that is parallel and adjacent to a rear edge of the top panel 60, each bore being in the form of a bolt hole. Similarly, each attachment flange 28 includes a bore 30 parallel and adjacent to the back wall 18 of the base member 14. A guide flange 32 fixedly attached to the back wall 18 also defines a bore 34 aligned with the same imaginary axis as the attachment flange bores (FIG. 3). The front portion 78 of the guide members 74 operates as a stop to the attachment flanges 28 such that the bores of the guide members 74 and attachment flanges 28 register with one another when the top panel 60 is slidably coupled to the base member 14. The portable lock box 10 includes an elongate rod 80 which may be extended through the guide member bores 76, attachment flange bores 30, and guide flange bore 34 when properly aligned. One end of the rod 80 includes a hole 84 for receiving a padlock 82 therethrough for locking the rod 80 in the bores and precluding unauthorized removal of the top panel 60 from the base assembly 12. Therefore, the top panel 60 is locked in a configuration that covers the open top of the base assembly 12.

In use, the portable lock box 10 is cried to a desired location such as a beach along with selected items to be stowed therein. These items are placed in the compartment 72. The front closure member 40 is inserted through the open front of the base member 14 such that complementary first 22 and second 50 pluralities of spaced apart support members slidably engage one another. The front closure member 40 may then be selectively and slidably positioned at the FIG. 1 extended configuration or the FIG. 2 retracted configuration and selectably coupled to the base member 14 by inserting elongate fasteners 54 through appropriate apertures (FIGS. 3 and 4). Ballast 54*a* such as sand, ice, or the like may be deposited through the open top of the base assembly to make the lock box 10 quite inconvenient and undesirable to steal (FIG. 4). The top panel 60 may then be slidably coupled to the base member 14 and front closure member 40 through engagement of respective attachment flanges 28 and second support members 50 with respective portions of respective top panel guide members 74. With the top panel 60 properly positioned atop the base member 14, the rod 80 may be extended through appropriate bores and locked therein with a padlock 82 and thus to preclude unauthorized access to the compartment 72. This process may be reversed to disassemble the lock box 10.

Figure 8:
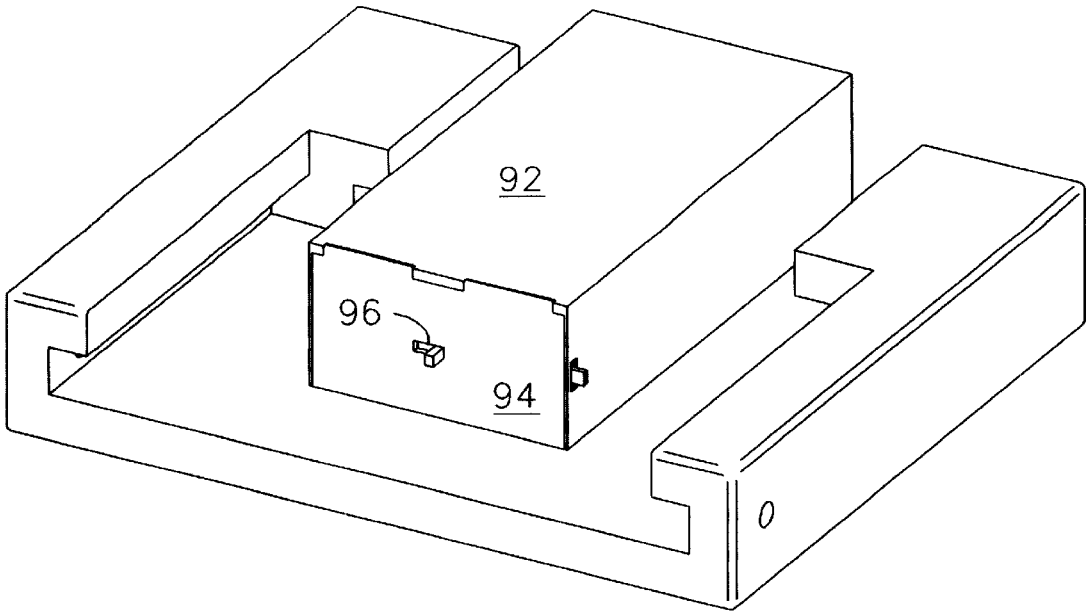
* and FIG. 8 is a perspective view of a bottom side of a top panel with a compartment according to another embodiment of the present invention.

Another embodiment of a portable lock box is shown in FIG. 8 and includes a construction substantially similar to that described previously except as specifically noted below. The compartment 92 in this embodiment is integrally connected to the handle member of the top panel and includes a door 94 pivotally coupled to the compartment housing. The door 94 may include a latch 96 for selectively opening and closing the door 94 and may even include its own lock (not shown).

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A portable lock box, comprising:

a base member having a bottom wall with a back wall and a pair of side walls extending upwardly from said bottom wall, said base member defining an open front and an open top;

a plurality of first support members positioned horizontally along respective inner surfaces of said side walls of said base member and vertically spaced apart;

a front closure member having a bottom wall with a front wall and a pair of side walls extending upwardly from said bottom wall, said front closure member defining an open back and an open top;

a plurality of second support members positioned horizontally along respective outer surfaces of said side walls of said front closure member and vertically spaced apart, each second support member adapted to rest atop a respective first support member for slidable movement therealong such that said front closure member is selectively received through said open front of said base member and slidably movable relative to said base member between a first configuration in which a free edge of said bottom wall of said front closure member is adjacent said back wall of said base member, a second configuration in which said free edge is displaced from said back wall, and a third configuration in which said front closure member is completely separated from said base member;

a top panel;

means for coupling said top panel to said base member for selectively covering said open top thereof, said base member, closure member, and top panel defining a primary chamber when coupled together for selectively receiving a ballast therein;

a compartment fixedly attached to a bottom surface of said top panel and defining an auxiliary chamber for holding selected items for safe keeping;

a pair of generally L-shaped guide members depending from a bottom side of said top panel and integrally connected to opposed side edges thereof, each guide member defining an inwardly facing channel and a first bore therethrough adjacent a rear edge of said top panel;

a pair of attachment flanges extending outwardly along top edges of respective side walls of said base member, each attachment flange having a configuration complementary to a configuration of a respective channel and adapted to mate therewith and move slidably therealong so as to couple said top panel to said base member, each attachment flange defining a second bore therethrough adjacent said back wall; and a rod for selective extension through said first and second bores when said top panel is positioned atop said base member such that respective first bores align with respective second bores, said rod adapted to be releasably locked therein when extended through said first and second bores.

2. The portable lock box as in claim 1 wherein each first support member defines spaced apart first and second apertures and each second support member defines a third aperture adjacent a free end thereof, said first and second apertures positioned to selectably receive an elongate fastener through respective first and third apertures or respective second and third apertures, whereby to releasably couple said front closure member to said base member at said first or second configuration, respectively.

3. The portable lock box as in claim 1 wherein said top panel comprises:

a top side defining a plurality of spaced apart recesses adapted to support respective beverage containers therein; and a handle member depending from a front edge thereof.

4. A portable lock box, comprising:

a base member having a bottom wall with a back wall and a pair of side walls extending upwardly from said bottom wall, said base member defining an open front and an open top;

a plurality of first support members positioned horizontally along respective inner surfaces of said side walls of said base member and vertically spaced apart;

a front closure member having a bottom wall with a front wall and a pair of side walls extending upwardly from said bottom wall, said front closure member defining an open back and an open top;

a plurality of second support members positioned horizontally along respective outer surfaces of said side walls of said front closure member and vertically spaced apart, each second support member adapted to rest atop a respective first support member for slidable movement therealong such that said front closure member is selectively received through said open front of said base member and slidably movable relative to said base member between a first configuration in which a free edge of said bottom wall of said front closure member is adjacent said back wall of said base member, a second configuration in which said free edge is displaced from said back wall, and a third configuration in which said front closure member is completely separated from said base member;

a top panel;

means for coupling said top panel to said base member for selectively covering said open top thereof, said base member, closure member, and top panel defining a primary chamber when coupled together for selectively receiving a ballast therein;

a compartment having side walls fixedly attached to said bottom surface of said top panel and a bottom wall connecting said side walls so as to define an auxiliary chamber positioned within said primary chamber for storing selected items separate from said ballast;

a pair of generally L-shaped guide members depending from said bottom surface of said top panel and integrally connected to opposed side edges thereof, each guide member defining an inwardly facing channel and a first bore therethrough adjacent a rear edge of said top panel;

a pair of attachment flanges extending outwardly along top edges of respective side walls of said base member, each attachment flange having a configuration complementary to a configuration of a respective channel and adapted to mate therewith and move slidably therealong so as to couple said top panel to said base member, each attachment flange defining a second bore therethrough adjacent said back wall;

a rod for selective extension through said first and second bores when said top panel is positioned atop said base member such that respective first bores align with respective second bores, said rod adapted to be releasably locked therein when extended through said first and second bores;

a top side defining a plurality of spaced apart recesses adapted to support respective beverage containers therein; and a handle member depending from a front edge thereof.

* * * * *